US007498993B1

(12) United States Patent
Lee et al.

(10) Patent No.: US 7,498,993 B1
(45) Date of Patent: Mar. 3, 2009

(54) MULTI-BAND CELLULAR ANTENNA

(75) Inventors: Kwan-ho Lee, Ann Arbor, MI (US); Wladimiro Villarroel, Ypsilanti, MI (US); Nuttawit Surittikul, Ann Arbor, MI (US); Jesus Gedde, Ann Arbor, MI (US)

(73) Assignee: AGC Automotive Americas R&D Inc., Ypsilanti, MI (US)

( * ) Notice: Subject to any disclaimer, the term of this patent is extended or adjusted under 35 U.S.C. 154(b) by 0 days.

(21) Appl. No.: 11/874,709

(22) Filed: Oct. 18, 2007

(51) Int. Cl.
*H01Q 1/32* (2006.01)

(52) U.S. Cl. ..... 343/713; 343/810

(58) Field of Classification Search ..... 343/700 MS, 343/713, 793, 795, 810
See application file for complete search history.

(56) References Cited

U.S. PATENT DOCUMENTS

| | | | | |
|---|---|---|---|---|
| 3,369,245 | A | 2/1968 | Rea | |
| 5,353,039 | A | 10/1994 | Tsukada et al. | |
| 6,329,649 | B1 * | 12/2001 | Jack et al. | 250/250 |
| 6,421,018 | B1 * | 7/2002 | Zeilinger et al. | 343/713 |
| 6,424,309 | B1 | 7/2002 | Johnston et al. | |
| 6,429,819 | B1 | 8/2002 | Bishop et al. | |
| 6,847,328 | B1 | 1/2005 | Libonati et al. | |
| 6,906,675 | B2 | 6/2005 | Satoh et al. | |
| 7,019,704 | B2 | 3/2006 | Weiss | |
| 7,050,013 | B2 | 5/2006 | Kim et al. | |
| 7,126,151 | B2 * | 10/2006 | Estes et al. | 257/25 |
| 7,177,236 | B2 | 2/2007 | Harchanko et al. | |
| 7,177,515 | B2 | 2/2007 | Estes et al. | |
| 7,197,207 | B2 * | 3/2007 | Hobbs et al. | 385/31 |
| 7,365,693 | B2 * | 4/2008 | Hoshiai et al. | 343/711 |
| 2005/0200549 | A1 | 9/2005 | Thompson et al. | |
| 2007/0097009 | A1 | 5/2007 | Torres | |

FOREIGN PATENT DOCUMENTS

| | | |
|---|---|---|
| JP | 2003087045 | 3/2003 |
| JP | 2003087050 | 3/2003 |
| WO | WO2005031919 A1 | 4/2005 |

OTHER PUBLICATIONS

English language translation and abstract for JP2003-087045, Dec. 14, 2007, 20 pages.
English language translation and abstract for JP2003-087050, Dec. 14, 2007, 33 pages.

* cited by examiner

*Primary Examiner*—Tan Ho
(74) *Attorney, Agent, or Firm*—Howard & Howard Attorneys PLLC

(57) ABSTRACT

An antenna for receiving and/or transmitting radio frequency (RF) signals at multiple cellular frequency bands is disposed on a non-conductive pane. The antenna includes a first antenna element and a second antenna element. The first antenna element has a first radiating element and a second radiating element arranged together in an opposing relationship to form a first bowtie shape. The second antenna element is spaced from the first antenna element and has a third radiating element and a fourth radiating element arranged together in an opposing relationship to form a second bowtie shape with a different dimension than the first bowtie shape. A first trace element connects to and extends between said first and third radiating elements and a second trace element connects to and extends between said second and fourth radiating elements. The antenna establishes an electromagnetic coupling for dual band operation at the multiple cellular frequency bands.

25 Claims, 8 Drawing Sheets

MULTI-BAND CELLULAR ANTENNA

FIELD OF THE INVENTION

The subject invention generally relates to an antenna for receiving and/or transmitting radio frequency (RF) signals at multiple cellular frequency bands.

BACKGROUND OF THE INVENTION

Vehicles have long implemented glass to enclose a cabin of the vehicle while still allowing visibility for the driver of the vehicle. The glass is typically disposed on an angle to enclose the cabin. Automotive glass is typically either a tempered (or toughened) glass or a laminated glass which is produced by bonding two or more panes of glass together with a plastic interlayer. The characteristics of glass such as automotive glass, and the angled disposition of this glass when applied as a window of a vehicle, provide challenges to the effective integration of an antenna with the window of the vehicle. Automotive manufacturers have strict requirements as to the amount of visual obstruction caused by antennas integrated with windows of the vehicle. As is known in the art, one of the more stringent requirements is that a footprint of an antenna disposed on glass must not limit the driver's visibility or visually block an area larger than approximately 100 mm×100 mm. Some vehicle designs utilize black ceramics along the periphery of the window of the vehicle. In this case, when the antenna is also placed on the periphery of the window, the antenna pattern is less visible to the driver. However, this placement limits the placement flexibility and potentially the performance of the antenna.

This integration of the antenna with the window improves aerodynamic performance of the vehicle and presents the vehicle with an aesthetically-pleasing, streamlined appearance. Integration of antennas for receiving RF signals, such as those generated by AM/FM terrestrial broadcast stations, has been a principal focus of the industry. However, to meet customer demand for wireless communication applications in the vehicle, the focus is expanding to integrating antennas for transmitting and/or receiving RF signals in cellular frequency bands.

Currently, there are several wireless communication applications that utilize different cellular frequency bands. For example, two cellular frequency bands utilized in North America are the Advanced Mobile Phone Service (AMPS), ranging from 824-894 MHz and the Personal Communication Service (PCS), ranging from 1850-1990 MHz. To have compatibility with these wireless communication applications, the vehicle may have multiple antennas. Multiple antennas enable the vehicle to transmit and/or receive signals in each of the different cellular frequency bands.

Various antennas for transmitting and/or receiving RF signals in the cellular frequency bands are well known in the art. Several of these antenna types are non-conformal when applied to a window (e.g. a whip, mast, or patch). An example of such an antenna is disclosed in the U.S. Pat. No. 6,429,819 (the '819 patent) to Bishop et al. The '819 patent discloses an antenna disposed on one side of a dielectric substrate, such as a printed circuit board, that includes a first antenna element and a second antenna element. A ground plane is disposed substantially parallel to and spaced from the first and second antenna elements. The first antenna element is a conductive patch having a rectangular shape measuring 127 mm×127 mm. The second antenna element includes two radiating elements defined as a slot within the first antenna element and arranged to form a bowtie shape. Additionally, the antenna of the '819 patent includes backside antenna elements located within a perimeter of the second antenna element and disposed on the opposite side of the dielectric substrate. The first antenna element provides a resonance at a first cellular frequency band, ranging from 880-960 MHz, and the second antenna element and the backside antenna elements provide a resonance at a second cellular frequency band, ranging from 1920-2170 MHz.

Notably, because the antenna of the '819 patent has antenna elements disposed on both sides of the dielectric, there are manufacturing challenges when integrating such a design on automotive glass such as tempered glass. For example, a radome may be needed to protect the first antenna elements and the ground plane or backside antenna elements from exposure to moisture, wind, dust, etc. that are present outside of the vehicle. Additionally, the antenna of the '819 patent has a larger footprint than desired by the automotive manufacturers to be integrated with automotive glass.

Therefore, it would be desirable to develop an improved antenna integrated with the window of the vehicle that is capable of transmitting and/or receiving RF signals in each of the different cellular frequency bands demanded by the wireless communication applications. Additionally, there remains an opportunity for a high-performing antenna that, when integrated with an automotive window, does not create a substantial visual obstruction nor alter the aesthetic appearance of the vehicle yet still maintains optimal reception.

SUMMARY OF THE INVENTION AND ADVANTAGES

The subject invention provides a window having an integrated antenna, i.e., an antenna that is integrated with the window. The integrated antenna of the subject invention achieves dual band operation at a first frequency band and a second frequency band. The window includes a nonconductive pane, a first antenna element, a second antenna element, and first and second trace elements.

The first antenna element is disposed on the nonconductive pane and has a first radiating element and a second radiating element. The first and second radiating elements are arranged together in an opposing relationship to form a first bowtie shape. The second antenna element is also disposed on the nonconductive pane. The second antenna element is spaced from the first antenna element and has a third radiating element and a fourth radiating element. Like the first and second radiating elements of the first antenna element, the third and fourth radiating elements of the second antenna element are arranged together in an opposing relationship. This opposing relationship forms a second bowtie shape with a different dimension than that of the first bowtie shape.

The antenna of the subject invention provides excellent performance characteristics when transmitting and/or receiving RF signals in the first and second cellular frequency bands. These characteristics include high radiation gain, high radiation efficiency, and wider bandwidths at the first and second frequency bands. Because the antenna of the subject invention is integrated with the window, the antenna is generally conformal with the window and is relatively compact, occupying a relatively small area of the window, yet still providing a high performance when transmitting or receiving cellular RF signals. Further, the layout and compact size of the antenna make it non-obtrusive to the driver's visibility and therefore minimizes aesthetic and safety obstructions. Therefore, the antenna of the subject invention is desirable for automotive manufacturers and drivers of the vehicles.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
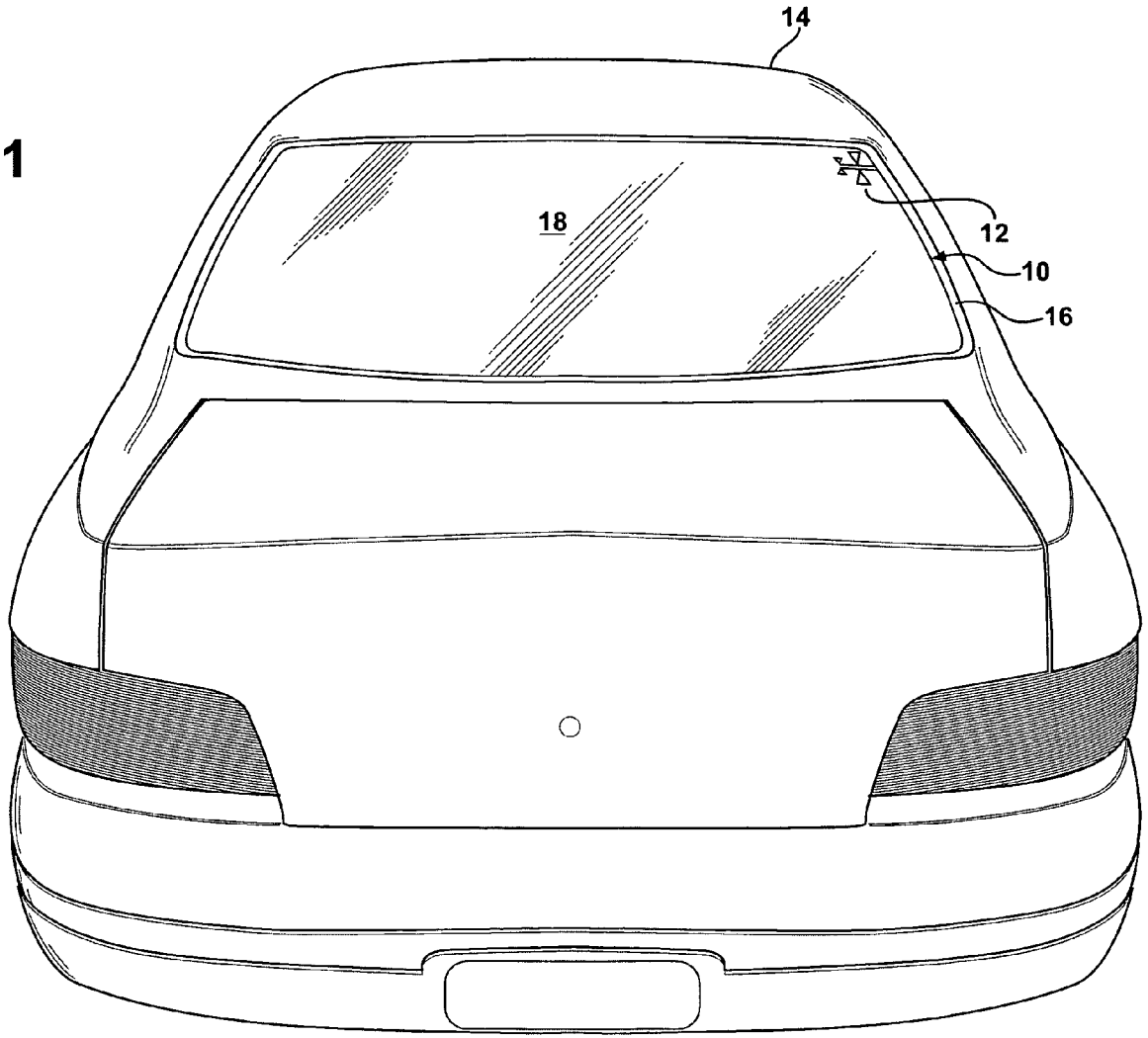
FIG. 1 is a perspective view of a vehicle with an antenna disposed on a non-conductive pane.

Referring to the Figures, wherein like numerals indicate like parts throughout the several views, a window 10 having an integrated antenna 12 for dual band operation at a first frequency band and a second frequency band is generally shown. This window 10 may be a rear window (backlite) as shown in FIG. 1, a front window (windshield), or any other window of a vehicle 14. The integrated antenna 12, hereinafter simply referred to as the antenna 12, may also be implemented in other situations completely separate from the vehicle 14, such as on a building or integrated with a radio transceiver, as long as the transceiver includes a non-conductive pane 16.

The window 10 includes the non-conductive pane 16. The term "nonconductive" refers to a material, such as an insulator or dielectric, that when placed between conductors of different potentials, permits only a small or negligible current in phase with the applied voltage to flow through material. Typically, nonconductive materials have conductivities on the order of nanosiemens/meter.

The nonconductive pane 16 is preferably automotive glass and more preferably soda-lime-silica glass. Although not required, the nonconductive pane 16 typically defines a thickness between 1.5 and 5.0 mm, preferably 3.1 mm. The nonconductive pane 16 also typically has a relative permittivity between 5 and 9, preferably 7. Those skilled in the art, however, realize that the nonconductive pane 16 may be formed from plastic, fiberglass, or other suitable nonconductive materials, and can be of any thickness and have any relative permittivity.

The non-conductive pane 16 of the preferred embodiment has a relative permittivity of 7. Therefore, the non-conductive pane 16 affects the performance characteristics of the antenna 12. It is to be understood that the antenna 12 may be modified (or tuned) for similar performance in alternative embodiments where the non-conductive pane 16 is a material other than automotive glass.

In the preferred embodiment, the nonconductive pane 16 is implemented as at least one pane of glass 18. Of course, the window 10 may include more than one pane of glass 18. Those skilled in the art realize that automotive windows, particularly windshields, may include two panes of glass sandwiching a layer of polyvinyl butyral (PVB). Further, the nonconductive pane 16 typically is a transparent pane of glass 18. Glass is an amorphous material and an insulator so it is inherently transparent. As is understood by those skilled in the art, a transparent pane of automotive glass 18 is clear (i.e., not opaque) and typically has a visible light transmittance (LTA) value greater than or equal to seventy percent (70%) at approximately 380-760 nanometers wavelength. It is to be understood that a shadeband can be applied to an uppermost region of the nonconductive pane 16 and/or a black ceramic obscuration band can be applied to a periphery of the nonconductive pane 16.

For descriptive purposes only, the subject invention is referred to below only in the context of the preferred nonconductive pane 16, which is the pane of automotive glass 18. This is not to be construed as limiting, since, as noted above, the antenna 12 can be implemented with nonconductive panes 16 other than panes of glass 18.

The pane of automotive glass 18 can function as a radome to the antenna 12. That is, the pane of automotive glass 18 protects the other components of the antenna 12, as described in detail below, from exposure to moisture, wind, dust, etc. that are present outside the vehicle 14.

Figure 2:
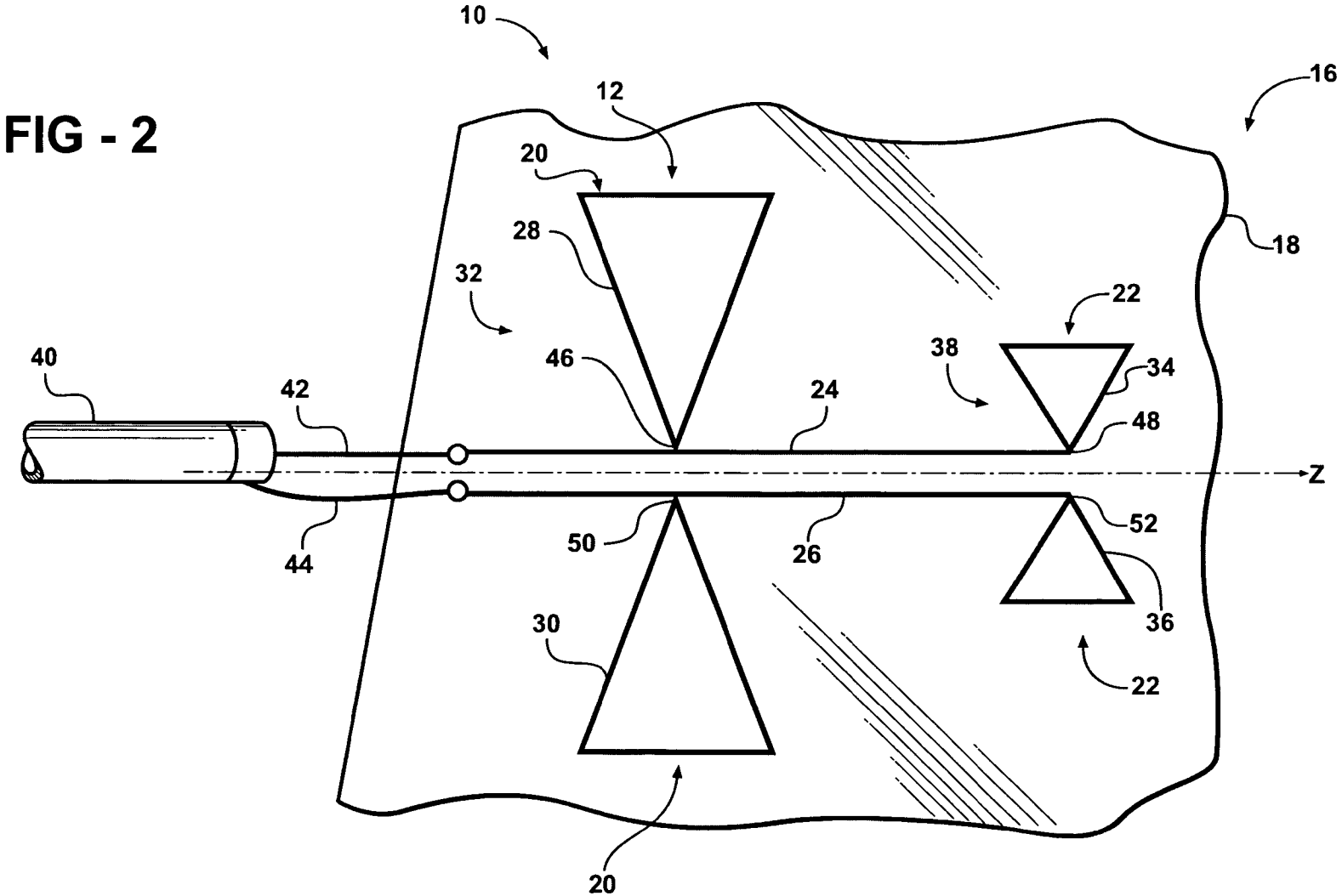
FIG. 2 is a perspective view of one embodiment of the antenna showing a first antenna element, a second antenna element, a first trace element, a second trace element.
Figure 3:
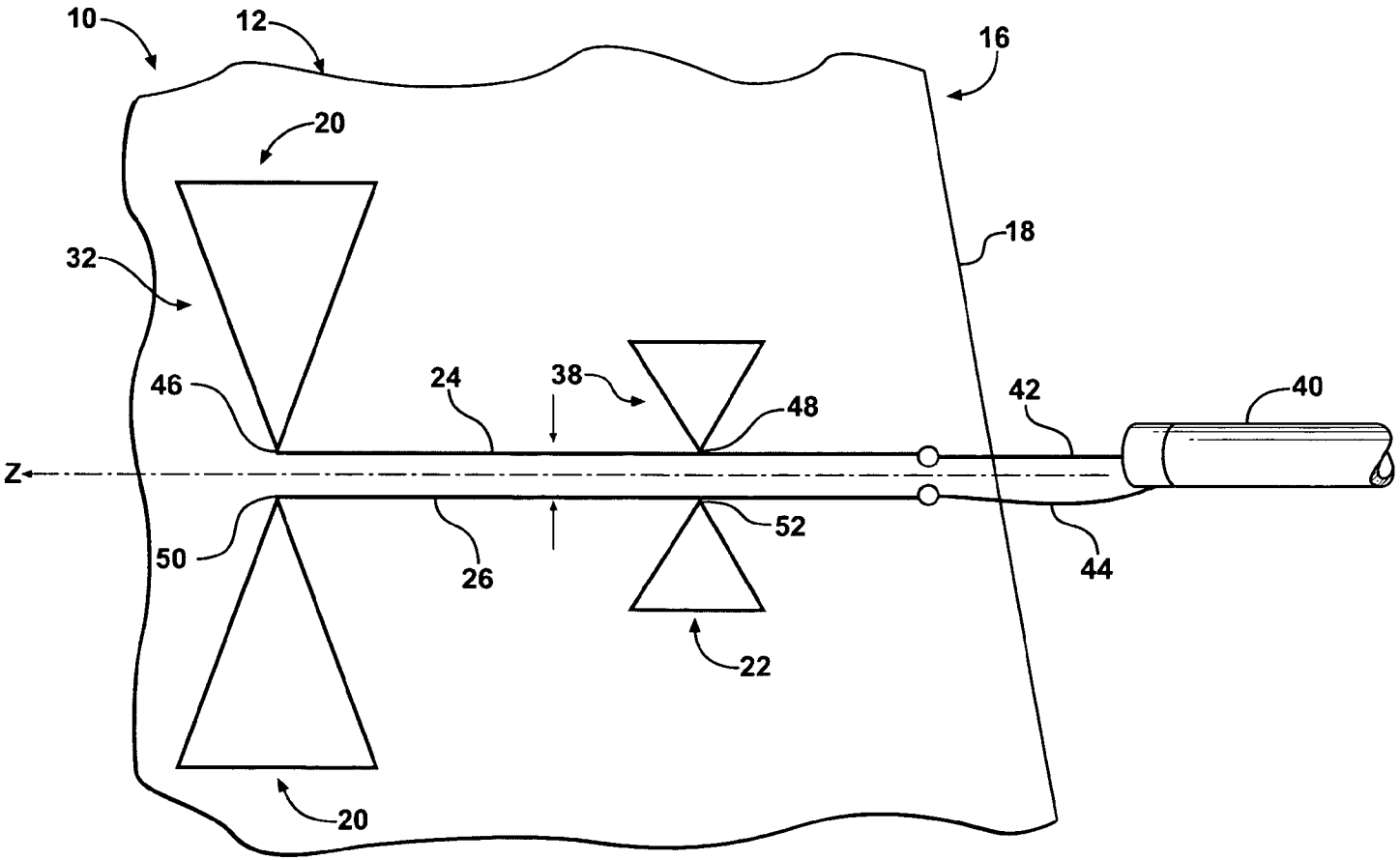
FIG. 3 is a perspective view of an alternative embodiment for feeding the antenna.

As illustrated in FIG. 2, the antenna 12 is electrically connected to the RF circuitry (not shown) of the vehicle 14 via an antenna feeder 40, such as a coaxial cable. More specifically, the antenna feeder 40 includes an inner conductor 42 and an outer conductor 44. FIG. 3 shows an alternative embodiment for feeding the antenna 12. The antenna feeder 40 connects to the distal end 48 of the first trace element 24 and the distal end 52 of the second trace element 26. Further, the orientation of antenna 12 and/or feed structure could be rotated depending on the location of the antenna 12 in the vehicle 14.

The antenna 12 of the subject invention includes a first antenna element 20, a second antenna element 22, a first trace element 24, and a second trace element 26. The first antenna element 20 is disposed on the nonconductive pane 16 and has a first radiating element 28 and a second radiating element 30. The first and second radiating elements 28, 30, which are described additionally below, are arranged together in an opposing relationship to form a first bowtie shape 32.

As with the first antenna element 20, the second antenna element 22 is disposed on the nonconductive pane 16. The second antenna element 22 is spaced from the first antenna element 20 and has a third radiating element 34 and a fourth radiating element 36. The third and fourth radiating elements 34, 36 are arranged together in an opposing relationship to form a second bowtie shape 38. As shown in the Figures, particularly in FIG. 2, the second bowtie shape 38, formed by the third and fourth radiating elements 34, 36, has a different dimension than the first bowtie shape 32, which is formed by the first and second radiating elements 28, 30 of the first antenna element 20.

Figure 4:
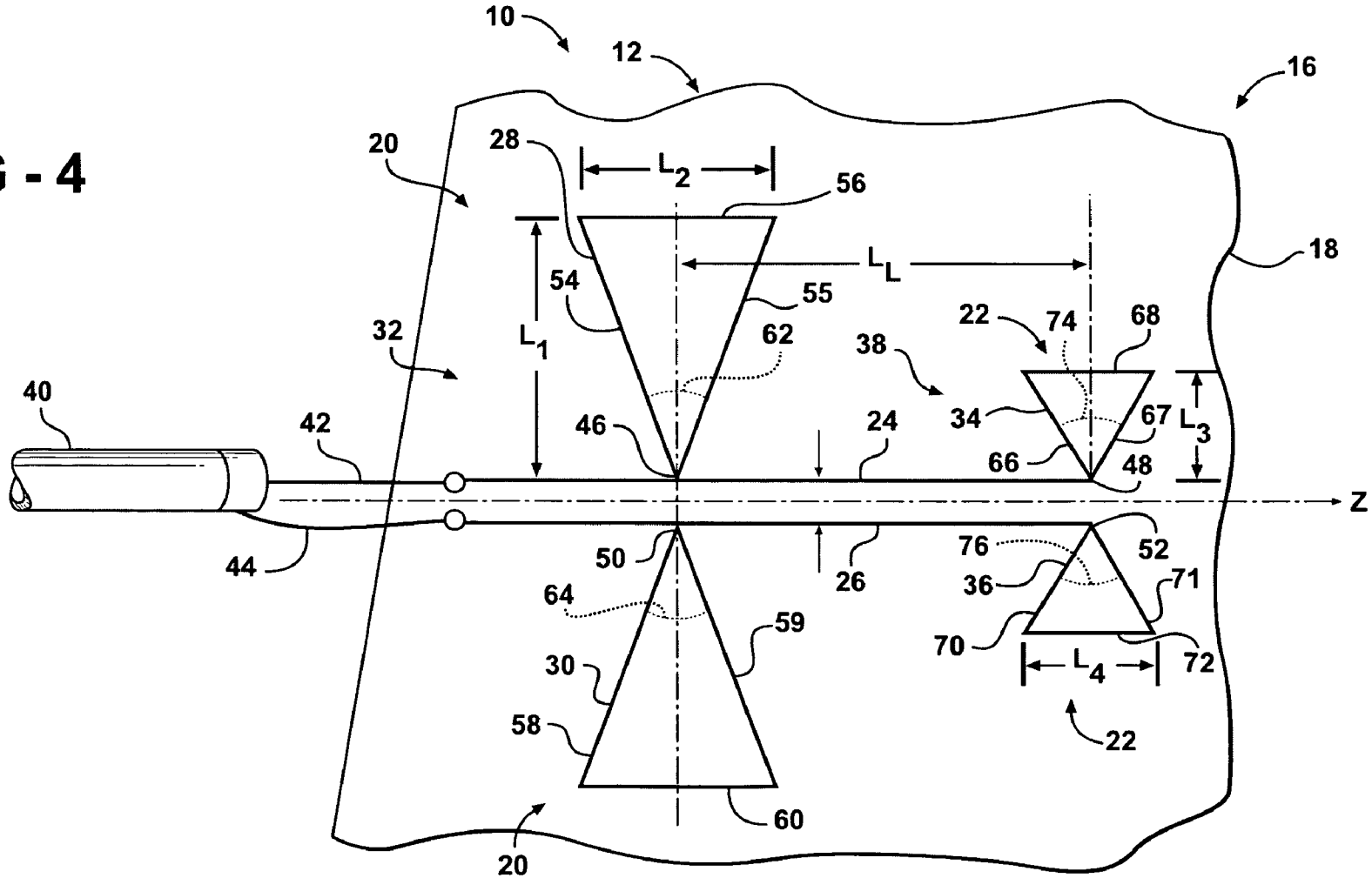
FIG. 4 is a perspective view of the antenna including dimensions.

The first and second radiating elements 28, 30 establish a perimeter on the non-conductive pane 16 and are arranged together in an opposing relationship to form the first bowtie shape 32. Preferably, the first and second radiating elements 28, 30 have identical dimensions and shape and the first radiating element 28 is a mirror image of the second radiating element 30, with respect to a z-axis extending as illustrated in FIG. 4. Also, the first and second radiating elements 28, 30 are dimensioned to provide resonance and bandwidth of the antenna 12 to operate in the first frequency band, ranging from 824-894 MHz.

The third and fourth radiating elements 34, 36 also establish a perimeter on the non-conductive pane 16 and are arranged together in an opposing relationship to form the second bowtie shape 38. Preferably, the third and fourth radiating elements 34, 36 have identical dimensions and shape and the third radiating element 34 is a mirror image of the fourth radiating element 36, with respect to the z-axis which is also illustrated in FIG. 4. Also, the third and fourth radiating elements 34, 36 are dimensioned to provide resonance and bandwidth of the antenna 12 to operate in the second frequency band, ranging from 1850-2170 MHz. Of course, other ranges of dimensions of the first through fourth radiation elements 28, 30, 34, 36 are suitable to provide adequate operation of the antenna 12, depending on the desired first and second frequency bands and bandwidth.

Figure 5:
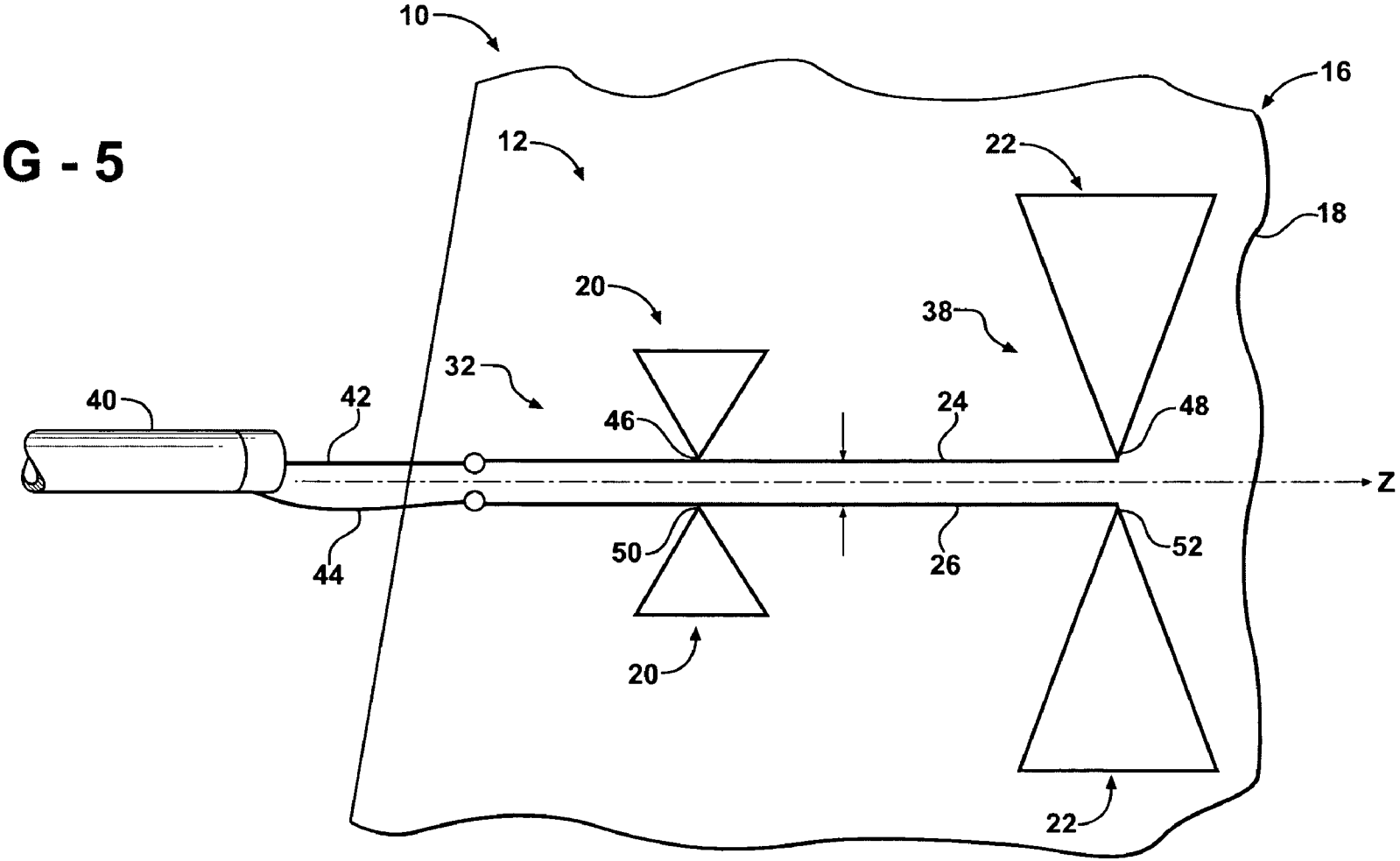
FIG. 5 is a perspective view of another embodiment of the antenna wherein the first antenna element is smaller than the second antenna element.

Referring again to FIG. 4, the dimensions of first radiating element 28 and third radiating element 34 are different in that the first radiating element 28 is larger than the third radiating element 34. Further, the dimensions of the second radiating element 30 and the fourth radiating element 36 are different in that the second radiating element 30 is larger than the fourth radiating element 36. In other words, the first antenna element 20 or the first bowtie shape 32 is larger than the second antenna element 22 or the second bowtie shape 38. It is to be understood that the antenna 12 can be designed such that the second antenna element 22 or the second bowtie shape 38 is larger than the first antenna element 20 or the first bowtie shape 32 as illustrated in the embodiment of the antenna in FIG. 5.

As indicated above, the antenna 12 of the present invention also includes the first trace element 24 and the second trace element 26. The first trace element 24 is connected to and extends between the first and third radiating elements 28, 34. The second trace element 26 is connected to and extends between the second and fourth radiating elements 30, 36. Both trace elements 24, 26 extend parallel to one another and are spaced apart preferably by 2 mm. As shown in FIG. 4, the length LL of each of the first and second trace elements 24, 26 measures about one-eighth of an effective wavelength $\lambda$ corresponding to an average of the center frequencies of the first and second frequency bands. In the subject invention, the effective wavelength determination takes into consideration the dielectric constant of the non-conductive pane 16. The length of each of the first and second trace elements 24, 26 ranges from 40-60 mm. Both of the trace elements 24, 26 establish an electromagnetic coupling between the first antenna element 20 and the second antenna element 22 for the dual band operation referenced above.

The first and second antenna elements 20, 22 and the first and second trace elements 24, 26 are formed of an electrically conductive material. More specifically, the first and second antenna elements 20, 22 are not defined within a patch-type radiating element. Instead, the first and second antenna elements 20, 22 are formed from printed silver, metal wire, or a combination of both applied directly to the window 10. The first and second trace elements 24, 26 are similarly formed from printed silver or metal wire applied directly to the window 10. Those skilled in the art understand that the antenna 12 can be applied directly to the window 10 by standard printing techniques, such as defogger line or AM/FM antenna printing methods.

Referring to FIG. 4, the first trace element 24 has a proximal end 46 connected to the first radiating element 28 and a distal end 48 connected to the third radiating element 34. The second trace element 26 has a proximal end 50 connected to the second radiating element 30 and a distal end 52 connected to the fourth radiating element 36. Both of the proximal ends 46, 50 provide an electrical connection to the antenna 12. As illustrated in FIGS. 2-5 and 7-8, the proximal ends 46, 50 of the first and second trace elements 24, 26 are connected to the RF circuitry via the inner conductor 42 and the outer conductor 44, respectively. It is to be appreciated that the connection can be reversed. For example, the proximal end 46 of the first trace element 24 can be connected to the outer conductor 44 and the proximal end 50 of the second trace element 26 can be connected to the inner conductor 42.

Referring back to the first and second radiating elements 28, 30, and the third and fourth radiating elements 34, 36, the first and third radiating elements 28, 34 extend from the proximal and the distal ends 46, 48 of the first trace element 24, respectively, and the second and fourth radiating elements 30, 36 extend from the proximal and the distal ends 50, 52 of the second trace element 26, respectively.

More specifically, the first radiating element 28 includes a first segment 54 and a second segment 55, preferably of the same length, originating at and diverging from the proximal end 46 of the first trace element 24 with both segments 54, 55 connecting to a third segment 56 to form a closed loop having a generally triangular shape. The first, second, and third segments 54, 55, 56 of the first radiating element 28 establish a perimeter and there is no conductive material within the perimeter, such that aesthetic and visibility obstructions are minimized when the antenna 12 of the subject invention is applied to the window 10 of a vehicle 14.

The second radiating element 30 also includes a first segment 58 and second segment 59 preferably of the same length, originating at and diverging from the proximal end 50 of the second trace element 26, with both segments connecting to a third segment 60 to form a closed loop having a generally triangular shape. The first, second, and third segments 58, 59, 60 of the second radiating element 30 also establish a perimeter and there is no conductive material within the perimeter, such that aesthetic and visibility obstructions are minimized. The length $L_1$ of the first and second segments 54, 55, 58, 59 of the first and second radiating elements 28, 30 typically ranges from 40 mm to 50 mm. The length $L_2$ of the third segments 56, 60 of the first and second radiating elements 28, 30 typically measures in a range from 15 mm to 35 mm.

As illustrated in FIG. 4, the first and second segments 54, 55 of the first radiating element 28 divergently extend from the proximal end 46 of the first trace element 24 to form a first angle 62. The first and second segments 58, 59 of the second radiating element 30 divergently extend from the proximal end 50 of the second trace element 26 to form a second angle 64. The first angle 62 and second angle 64 each preferably measures about 40 to 45 degrees.

Referring again to FIG. 4, the third radiating element 34 also includes a first segment 66 and a second segment 67 preferably of the same length, originating at and diverging from the distal end 48 of the first trace element 24 with both segments 66, 67 connecting to a third segment 68 to form a closed loop having a generally triangular shape. The first, second, and third-segments 66, 67, 68 of the third radiating element 34 establish a perimeter and there is no conductive material or other non-transparent material within the perimeter, such that aesthetic and visibility obstructions are minimized.

The fourth radiating element 36 also includes a first segment 70 and a second segment 71, preferably of the same length, diverging from the distal end 52 of the second trace element 26 with both segments 70, 71 connecting to a third segment 72 to form a closed loop having a generally triangular shape. The first, second, and third segments 70, 71, 72 of the fourth radiating element 36 establish a perimeter and there is no conductive material within the perimeter, such that aesthetic and visibility obstructions are minimized. The length $L_3$ of the first and second segments 66, 67, 70, 71 of the third and fourth radiating elements 30, 32 typically ranges from 15 mm to 25 mm. The length $L_4$ of the third segments 68, 72 of the third and fourth radiating elements 34, 36 measure in a range from 15 mm to 35 mm.

In FIG. 4, the first and second segments 66, 67 of the third radiating element 34 divergently extend from the distal end 48 of the first trace element 24 to form a third angle 74. The first and second segments 70, 71 of the fourth radiating element 36 divergently extend from the distal end 52 of the second trace element 26 to form a fourth angle 76. Each of the third and fourth angles 74, 76 preferably measures about 60 to 65 degrees.

Figure 6:
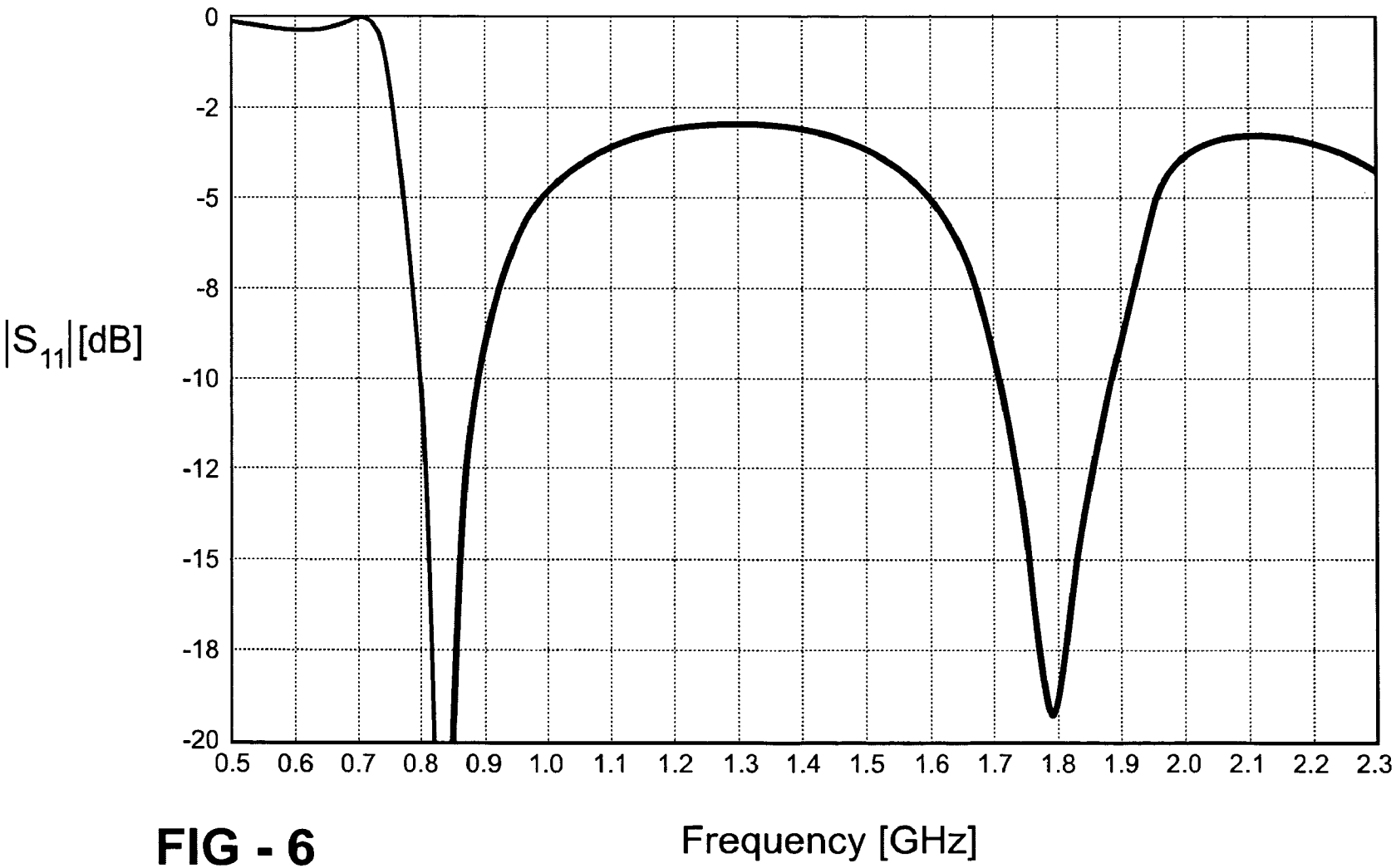
FIG. 6 is a chart illustrating the magnitude of the S11 parameter in dB of the first embodiment of the antenna.

FIG. 6 is a chart illustrating the magnitude of the S11 parameter in dB of the antenna 12. Typically, an antenna is said to operate at a given frequency band when the corresponding S11 parameter magnitude values are at or below −10 dB. As shown by this chart, the antenna 12 of the subject invention exhibits dual band operation at the first and second frequency bands.

Figure 7:
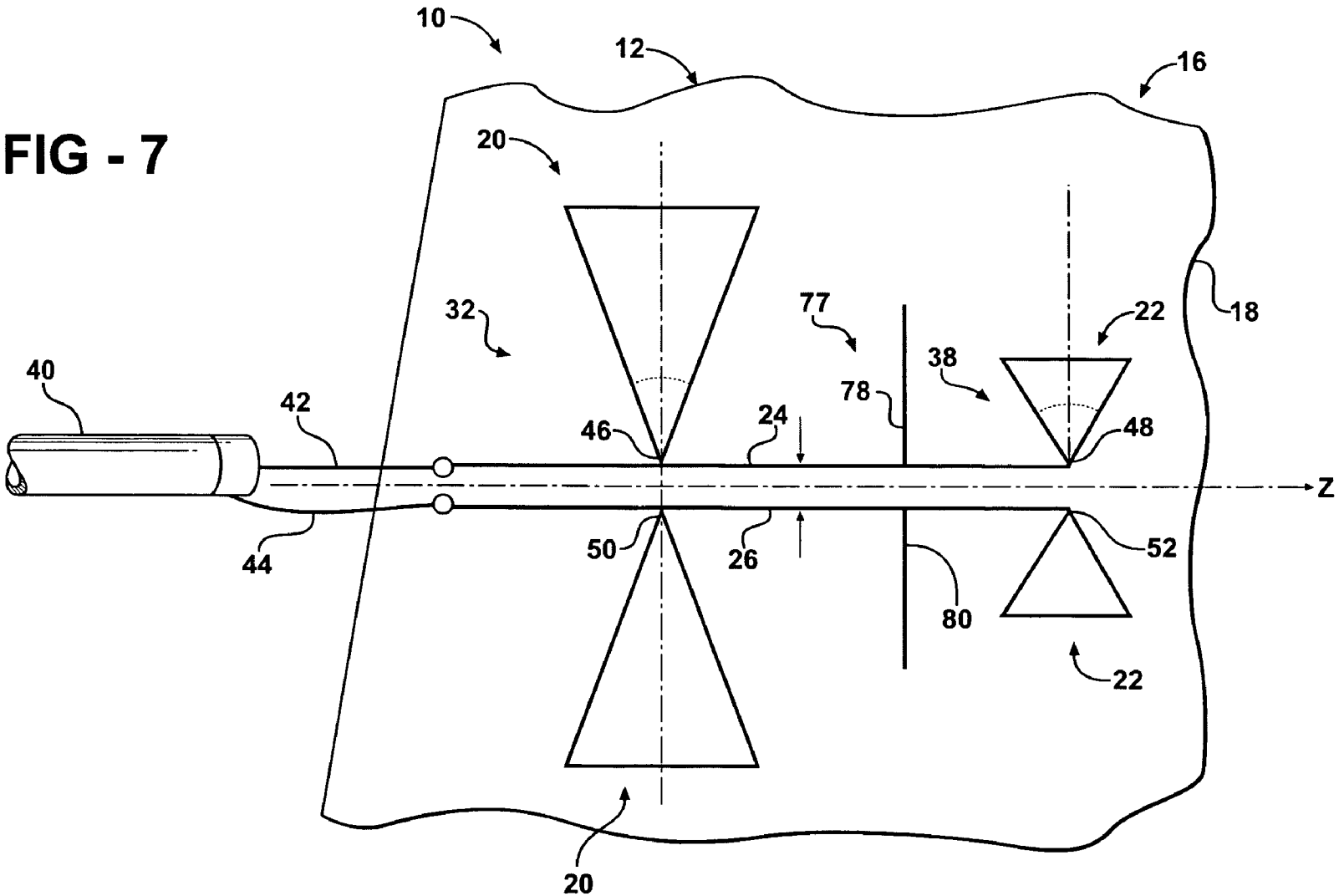
FIG. 7 is a perspective view of a further embodiment of the antenna illustrating a pair of tuning elements disposed between the first antenna element and the second antenna element.
Figure 8:
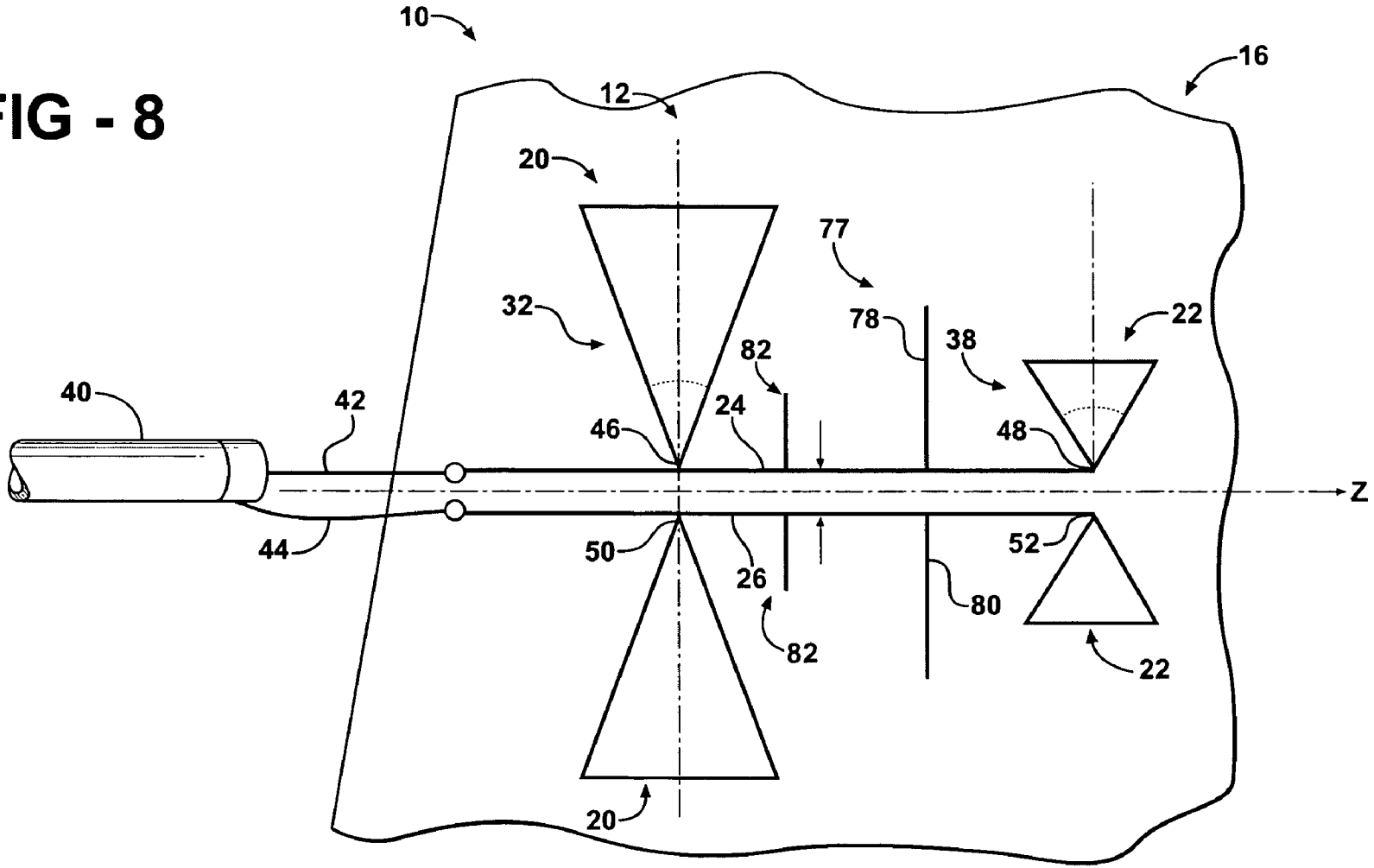
FIG. 8 is a perspective view of yet another embodiment of the antenna including a plurality of tuning elements disposed between the first antenna element and the second antenna element.

As shown alternatively in FIGS. 7 and 8, the antenna 12 of the present invention may also include at least one tuning element 77 disposed between the first antenna element 20 and the second antenna element 22 and formed from printed silver, metal wire, or a combination of both. As illustrated in FIG. 7, a first tuning element 78 extends substantially perpendicular from the first trace element 24 and a second tuning element 80 extends substantially perpendicular from the second trace element 26. Adjusting the lengths and locations of the first and second tuning elements 78, 80 assist the antenna 12 in proper operation at the first and second frequency bands. It is to be appreciated that the antenna 12 may include additional tuning elements 82 as shown in FIG. 8.

Obviously, many modifications and variations of the present invention are possible in light of the above teachings. The invention may be practiced otherwise than as specifically described within the scope of the appended claims.

What is claimed is:

1. A window having an integrated antenna for dual band operation at a first frequency band and a second frequency band, said window comprising:

a nonconductive pane;

a first antenna element disposed on said nonconductive pane and having a first radiating element and a second radiating element arranged together in an opposing relationship to form a first bowtie shape;

a second antenna element disposed on said nonconductive pane and spaced from said first antenna element, said second antenna element having a third radiating element and a fourth radiating element arranged together in an opposing relationship to form a second bowtie shape with a different dimension than said first bowtie shape; and a first trace element connected to and extending between said first and third radiating elements and a second trace element connected to and extending between said second and fourth radiating elements, both of said trace elements establishing an electromagnetic coupling for said dual band operation.

2. A window as set forth in claim 1 wherein said first trace element has a proximal end connected to said first radiating element and a distal end connected to said third radiating element, and said second trace element has a proximal end connected to said second radiating element and a distal end connected to said fourth radiating element with both of said proximal ends providing an electrical connection to said integrated antenna.

3. A window as set forth in claim 2 wherein said first and third radiating elements extend from said proximal and said distal ends of said first trace element, respectively, and said second and fourth radiating elements extend from said proximal and said distal ends of said second trace element, respectively.

4. A window as set forth in claim 1 wherein;

said first radiating element comprises a first segment and a second segment originating at and divergently extending from said proximal end of said first trace element and connecting to a third segment of said first radiating element which extends between said first and second segments to form said first radiating element in a closed loop having a triangular shape, said second radiating element comprises a first segment and a second segment originating at and divergently extending from said proximal end of said second trace element and connecting to a third segment of said second radiating element which extends between said first and second segments to form said second radiating element in a closed loop having a triangular shape, said third radiating element comprises a first segment and a second segment originating at and divergently extending from said distal end of said first trace element and connecting to a third segment of said third radiating element which extends between said first and second segments to form said third radiating element in a closed loop having a triangular shape, and said fourth radiating element comprises a first segment and a second segment originating at and divergently extending from said distal end of said second trace element and connecting to a third segment of said fourth radiating element which extends between said first and second segments to form said fourth radiating element in a closed loop having a triangular shape.

5. A window as set forth in claim 4 wherein said first segment and second segments of said first radiating element divergently extend from said proximal end of said first trace element to form a first angle, and said first segment and second segments of said second radiating element divergently extend from said proximal end of said second trace element to form a second angle, and wherein each of said first and second angles measures about 45 degrees.

6. A window as set forth in claim 4 wherein said first segment and second segments of said third radiating element divergently extend from said distal end of said first trace element to form a third angle, and said first segment and second segments of said fourth radiating element divergently extend from said distal end of said second trace element to form a fourth angle, and wherein each of said third and fourth angles measures about 64 degrees.

7. A window as set forth in claim 1 wherein said first radiating element is a mirror image of said second radiating element and said third radiating element is a mirror image of said fourth radiating element.

8. A window as set forth in claim 1 wherein said first and second radiating elements establish a perimeter on said nonconductive pane to form said first bowtie shape, and said third and fourth radiating elements establish a perimeter on said nonconductive pane to form said second bowtie shape, with said non-conductive pane spanning an entire area within said perimeters.

9. A window as set forth in claim 1 wherein said first bowtie shape of said first antenna element is larger than said second bowtie shape of said second antenna element.

10. A window as set forth in claim 1 wherein said second bowtie shape of said second antenna element is larger than said first bowtie shape of said first antenna element.

11. A window as set forth in claim 1 wherein a length of said first trace element and a length of said second trace element measures about one-eighth of an effective wavelength $\lambda$ corresponding to an average of the center frequencies of said first frequency band and said second frequency band.

12. A window as set forth in claim 1 wherein said first frequency band ranges from 824 MHz-894 MHz and said second frequency band ranges from 1850 MHz-2170 MHz and a length of each of said first and second trace elements ranges from 40 mm-60 mm.

13. A window as set forth in claim 1 wherein said first and second antenna elements and said first and second trace elements are formed of an electrically conductive material.

14. A window as set forth in claim 13 wherein said electrically conductive material is further defined as electrically conductive wire.

15. A window as set forth in claim 13 wherein said electrically conductive material is further defined as printed silver.

16. A window as set forth in claim 1 further comprising at least one tuning element disposed between said first antenna element and said second antenna element.

17. A window as set forth in claim 16 wherein said at least one tuning element extends substantially perpendicular from said first trace element.

18. A window as set forth in claim 16 wherein said at least one tuning element extends substantially perpendicular from said second trace element.

19. A window as set forth in claim 1 wherein said nonconductive pane is further defined as a transparent pane of glass.

20. A window as set forth in claim 19 wherein said pane of glass is further defined as automotive glass.

21. A window having an integrated antenna for dual band operation at a first frequency band ranging from 824 MHz-894 MHz and a second frequency band ranging from 1850 MHz-2170 MHz, said window comprising:

a nonconductive pane;

a first antenna element, formed of electrically conductive material, disposed directly on said nonconductive pane and having a first radiating element and a second radiating element arranged together in an opposing relationship to form a first bowtie shape;

a second antenna element, formed of electrically conductive material, disposed directly on said nonconductive pane and spaced from said first antenna element, said second antenna element having a third radiating element and a fourth radiating element arranged together in an opposing relationship to form a second bowtie shape with a different dimension than that of said first bowtie shape; and a first trace element, formed of electrically conductive material, disposed directly on said nonconductive pane connected to and extending between said first and third radiating elements and a second trace element, formed of electrically conductive material, disposed directly on said nonconductive pane connected to and extending between said second and fourth radiating elements, both of said trace elements establishing an electromagnetic coupling for said dual band operation.

22. A window as set forth in claim 21 wherein;

said first radiating element comprises a first segment and a second segment originating at and divergently extending from said proximal end of said first trace element and connecting to a third segment of said first radiating element which extends between said first and second segments to form said first radiating element in a closed loop having a triangular shape, said second radiating element comprises a first segment and a second segment originating at and divergently extending from said proximal end of said second trace element and connecting to a third segment of said second radiating element which extends between said first and second segments to form said second radiating element in a closed loop having a triangular shape, said third radiating element comprises a first segment and a second segment originating at and divergently extending from said distal end of said first trace element and connecting to a third segment of said third radiating element which extends between said first and second segments to form said third radiating element in a closed loop having a triangular shape, and said fourth radiating element comprises a first segment and a second segment originating at and divergently extending from said distal end of said second trace element and connecting to a third segment of said fourth radiating element which extends between said first and second segments to form said fourth radiating element in a closed loop having a triangular shape.

23. A window as set forth in claim 21 wherein said first radiating element is a mirror image of said second radiating element and said third radiating element is a mirror image of said fourth radiating element.

24. A window as set forth in claim 21 wherein said first and second radiating elements establish a perimeter on said nonconductive pane to form said first bowtie shape, and said third and fourth radiating elements establish a perimeter on said nonconductive pane to form said second bowtie shape, with said non-conductive pane spanning an entire area within said perimeters.

25. A window as set forth in claim 21 further comprising at least one tuning element disposed between said first antenna element and said second antenna element.

* * * * *